US010876230B2

(12) United States Patent
Watanabe et al.

(10) Patent No.: US 10,876,230 B2
(45) Date of Patent: Dec. 29, 2020

(54) ELASTIC CIRCULAR-KNITTED FABRIC

(71) Applicant: Asahi Kasei Kabushiki Kaisha, Tokyo (JP)

(72) Inventors: Tetsuyuki Watanabe, Tokyo (JP); Shoichi Akita, Tokyo (JP)

(73) Assignee: Asahi Kasei Kabushiki Kaisha, Tokyo (JP)

( * ) Notice: Subject to any disclaimer, the term of this patent is extended or adjusted under 35 U.S.C. 154(b) by 82 days.

(21) Appl. No.: 16/339,564

(22) PCT Filed: Oct. 10, 2017

(86) PCT No.: PCT/JP2017/036683
§ 371 (c)(1),
(2) Date: Apr. 4, 2019

(87) PCT Pub. No.: WO2018/074285
PCT Pub. Date: Apr. 26, 2018

(65) Prior Publication Data

US 2020/0040493 A1 Feb. 6, 2020

(30) Foreign Application Priority Data

Oct. 20, 2016 (JP) ..... 2016-206143

(51) Int. Cl.
*D04B 1/18* (2006.01)
*D04B 1/24* (2006.01)
(Continued)

(52) U.S. Cl.
CPC ..... *D04B 1/18* (2013.01); *D04B 1/24* (2013.01); *A41B 17/00* (2013.01); *A41D 13/00* (2013.01);
(Continued)

(58) Field of Classification Search
CPC . D04B 1/18; D04B 1/24; D04B 21/18; D04B 1/00; D04B 21/00; A41B 17/00;
(Continued)

(56) References Cited

U.S. PATENT DOCUMENTS 6,164,092 A 12/2000 Menaker
2016/0138203 A1 5/2016 Akita

FOREIGN PATENT DOCUMENTS

JP 2005-213662 A 8/2005
JP 2009-035846 A 2/2009
(Continued)

OTHER PUBLICATIONS

Supplementary European Search Report issued in corresponding European Patent Application No. 17862654.5 dated Oct. 2, 2019.
(Continued)

*Primary Examiner* — Danny Worrell
*Assistant Examiner* — Aiying Zhao
(74) *Attorney, Agent, or Firm* — Morgan, Lewis & Bockius LLP

(57) ABSTRACT

Provided is an elastic circular-knitted fabric that can be used for clothing such as underclothes, sportswear, or casual wear, and that is stretchable and has a pleasant feel. This elastic circular-knitted fabric contains knitted loops (c1) composed of non-elastic fibers, and knitted loops (c2) composed of non-elastic fibers and elastic fibers. The knitted loops (c2) composed of the non-elastic fibers and elastic fibers exist in the elastic circular-knitted fabric at a ratio of one course for every two courses. In a slope of the elongation stress curve in the warp direction and weft direction of the elastic circular-knitted fabric, a ratio (a2/a1) of a slope (a1) at 0-40% elongation to a slope (a2) at 40-80% elongation is no more than 1.0 in the respective directions, and the standard deviation of unevenness between the loops on the
(Continued)

rear surface of the elastic circular-knitted fabric is 0.5 or below.

16 Claims, 1 Drawing Sheet

(51) Int. Cl.
*A41B 17/00* (2006.01)
*A41D 13/00* (2006.01)
*D01F 6/70* (2006.01)
*D04B 21/18* (2006.01)

(52) U.S. Cl.
CPC ..... *D01F 6/70* (2013.01); *D04B 21/18* (2013.01); *D10B 2401/061* (2013.01)

(58) Field of Classification Search
CPC .... A41D 13/00; D01F 6/70; D10B 2401/061; D10B 2501/02
USPC ..... 66/202
See application file for complete search history.

(56) References Cited

FOREIGN PATENT DOCUMENTS

| | | | |
|---|---|---|---|
| JP | 2014-198914 | A | 10/2014 |
| JP | 2015-120983 | A | 7/2015 |
| JP | 2016-065331 | A | 4/2016 |
| WO | 2015/005432 | A | 1/2015 |

OTHER PUBLICATIONS

International Search Report issued in corresponding International Patent Application No. PCT/JP2017/036683 dated Jan. 16, 2018.
International Preliminary Report on Patentability issued in corresponding International Patent Application No. PCT/JP2017/036683 dated Apr. 23, 2019.

(SLOPE OF ELONGATION STRESS CURVE)

ELASTIC CIRCULAR-KNITTED FABRIC

FIELD

The present invention relates to an elastic circular-knitted fabric which combines stretchability and texture and which can be used for garments such as innerwear, sportswear, and casual clothing.

BACKGROUND

Conventionally, elastic circular-knitted fabrics containing elastic fibers are often used as garments which closely fit the body such as undergarments such as shorts and underwear, undershirts, and sportswear such as swimwear, and various products using the same are commercially available. In particular, garments which directly touch the skin are made of highly stretchable knitted fabrics so as to accommodate skin stretching when worn. Furthermore, elastic circular-knitted fabrics containing elastic fibers have been used for casual clothing such as T-shirts, parkas, and bottoms in addition to garments that closely fit the body, and investigations in order to achieve excellent stretchability have been made.

For example, Patent Literature 1 described below proposes a circular-knitted fabric which is excellent in soft stretchability in both directions by using a specific copolymer elastic yarn and making the stitch length of non-elastic fibers longer than elastic fibers. However, in such a specific copolymer elastic yarn, since the abrasion resistance is reduced, there is a problem in that the practical performance thereof as garment is inferior.

Furthermore, Patent Literature 2 described below proposes a circular-knitted fabric composed of elastic fibers and non-elastic fibers wherein the yarn length index of the non-elastic fibers is specified such that the elastic knitted fabric is excellent in extensibility and recoverability, exercise followability and wear feeling. However, according to such proposal, if the non-elastic fibers present in the knitted fabric become unnecessarily loosened, slack emerges on the front and rear surfaces of the knitted fabric. Thus, there is a potential problem in that roughness is felt due to the unevenness occurring in the knitted fabric, whereby texture when worn is worse.

Thus, an elastic circular-knitted fabric which combines both stretchability and texture has not yet been provided.

CITATION LIST

Patent Literature

[PTL 1] Japanese Unexamined Patent Publication (Kokai) No. 2005-213662

[PTL 2] WO 2015/005432

SUMMARY

Technical Problem

In light of the above state of the art, the object of the present invention is to provide an elastic knitted fabric which can combine both stretchability and texture and which is suitable for garments such as innerwear, sportswear, and casual clothing.

Solution to Problem

As a result of rigorous investigation in order to achieve the above object, the present inventors have discovered that a knitted fabric having the following characteristics can achieve the above object, and have completed the present invention.

In particular, the present invention is as follows.

[1] An elastic circular-knitted fabric comprising knitted loops (c1) composed of non-elastic fibers, and knitted loops (c2) composed of non-elastic fibers and elastic fibers, wherein the knitted loops (c2) composed of non-elastic fibers and elastic fibers are present in a ratio of one course for every two courses, elongation stress curves of the elastic circular-knitted fabric in the warp and weft directions have a ratio (a2/a1) of a slope (a1) at 0 to 40% elongation and a slope (a2) at 40 to 80% elongation of not greater than 1.0 in the respective directions, and the standard deviation of unevenness between loops on a rear surface of the elastic circular-knitted fabric is not greater than 0.5.

[2] The elastic circular-knitted fabric according to [1], wherein a yarn length index ratio (c1/c2) of the knitted loops (c1) composed of non-elastic fibers to the knitted loops (c2) composed of non-elastic fibers and elastic fibers is 1.3 to 1.7.

[3] The elastic circular-knitted fabric according to [1] or [2], wherein the slope (a2) in the warp direction at 40 to 80% elongation is not greater than 20 cN/%.

[4] The elastic circular-knitted fabric according to any one of [1] to [3], wherein a fineness ratio of the fineness of the non-elastic fibers used in the knitted loops (c1) composed of non-elastic fibers to the fineness of the non-elastic fibers used in the knitted loops (c2) composed of non-elastic fibers and elastic fibers is 2.0 to 4.0.

[5] The elastic circular-knitted fabric according to any one of [1] to [4], having a basis weight of 80 to 300 g/m$^2$.

[6] The elastic circular-knitted fabric according to any one of [1] to [5], wherein the knitting structure is a plain stitch structure.

Advantageous Effects of Invention

The elastic fabric of the present invention can combine stretchability and texture without impairing stretchability and without a rough texture.

DESCRIPTION OF EMBODIMENTS

Figure 1:
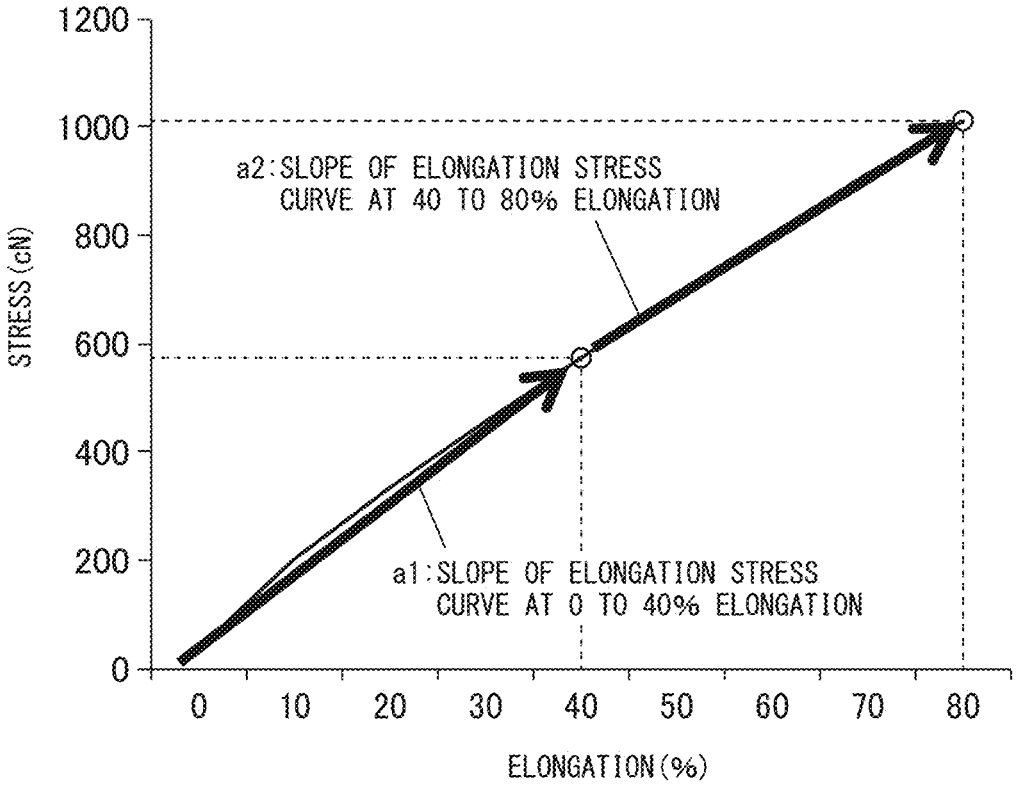
FIG. 1 is a view detailing the slope of a stress curve of the knitted fabric at the time of elongation.
Figure 2:
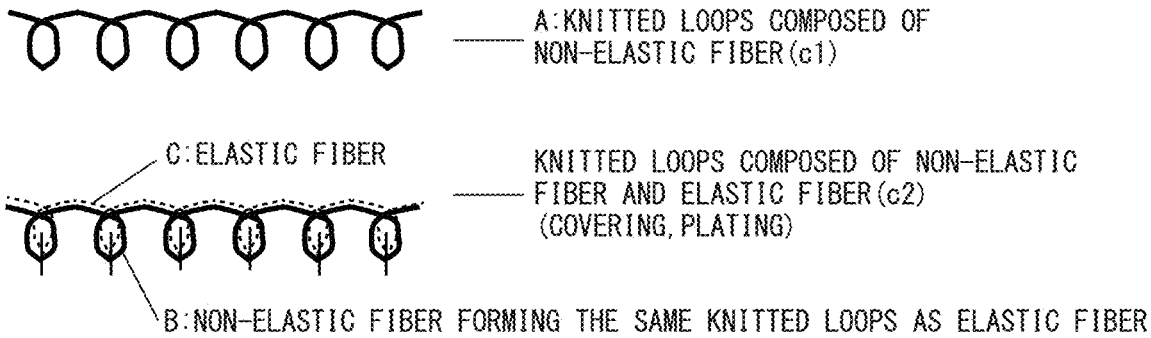
FIG. 2 is a view detailing the structure of knitted loops (c1) composed of non-elastic fibers and knitted loops (c2) composed of non-elastic fibers and elastic fibers.

The embodiments of the present invention will be described in detail below.

The elastic circular-knitted fabric of the present embodiment is characterized by the use of non-elastic fibers and elastic fibers.

In the present embodiment, the non-elastic fibers used in the knitted loops (c1) composed of non-elastic fibers and the knitted loops (c2) composed of non-elastic fibers and elastic fibers may be either a filament yarn or a spun yarn.

Specifically, preferred examples of the filament yarn include synthetic fibers such as polyamide fibers, polyester fibers, acrylic fibers, polypropylene fibers, vinyl chloride fibers, and cellulose fibers. The form of the filament fibers may be any of a yarn (raw fiber), a false-twist yarn, or a dyed yarn, and may be a composite or paralleled yarn thereof. The composite yarn is not particularly limited, and may be a fiber formed by air mixing, twisting, covering, false-twisting, or mixed false-twisting. The cross-sectional shape of the filament yarn is not particularly limited and may be, for example, a circular cross-section, a triangular cross-section, cross-shaped, W-shaped, M-shaped, C-shaped, I-shaped, dog bone-shaped, or a hollow fiber. Preferred examples of spun yarns include natural fibers such as cotton, wool, and hemp, and synthetic fibers such as polyamide fibers, polyester fibers, acrylic fibers, polypropylene fibers, vinyl chloride fibers, and cellulose fibers, and these may be used alone or in a mixed state. The mixing method is not particularly limited, and a spun yarn obtained using the MVS system in which piling is unlikely to occur is preferred. In other words, the material can be suitably selected in accordance with application.

The elastic circular-knitted fabric of the present embodiment is characterized by the presence of knitted loops (c2) (hereinafter referred to as "knitted loops comprising elastic fibers") composed of non-elastic fibers and elastic fibers at a ratio of one course for every two courses. The phrase "knitted loops composed of non-elastic fibers and elastic fibers which are present at a ratio of one course for every two courses" means that courses comprising the knitted loops (c1) composed of non-elastic fibers and courses comprising knitted loops (c2) composed of non-elastic fibers and elastic fibers are present in an alternating manner.

If all of the courses are c2 (knitted loops comprising elastic fibers), in the elongation stress curves of the knitted fabric in the warp and weft directions, the ratio of the slope (a1) at 0 to 40% elongation to the slope (a2) at 40 to 80% elongation exceeds 1 in the respective directions. This is because only the elastic fibers themselves are elongated in the 40 to 80% elongation region. The non-elastic fibers elongate as the knitted loops deform, whereby the fibers themselves do not stretch.

The stress applied in this 40 to 80% elongation region is the stress required to stretch the elastic fibers themselves and the stress required for deformation of non-elastic fibers. The determination of the slope is based on the stress of the elastic fibers.

If all of the courses are c2, since the "stress" during elongation stressing in the warp and weft directions becomes high and the slope ratio exceeds 1, stretchability deteriorates, whereby a stretched feeling is felt at the time of wearing. This is because the stress of the elastic fibers themselves is greater than the "stress" necessary for deformation of the non-elastic fibers.

The knitted loops comprising elastic fibers include covered yarns in which the elastic fibers are covered with the non-elastic fibers or fibers in which the non-elastic fibers have been plated with the elastic fibers.

Specifically, though a yarn comprising knitted loops in which the non-elastic fibers are plated with a polyurethane elastic yarn, polyether/ester elastic yarn, polyamide elastic yarn, or polyolefin elastic yarn or a yarn in which the non-elastic fibers are covered with one of these may be used, from the viewpoint of quality (shine and eye direction), a covered yarn in which the elastic fibers are covered with the non-elastic fibers is preferable.

The draft rate of the elastic fibers can be set to an appropriate value in accordance with the intended application of the product. In general, a draft rate of 2.0- to 4.0-fold is used, preferably in the range of 2.5- to 3.5-fold, more preferably 2.8- to 3.4-fold, further preferably 3.0- to 3.3-fold.

The fineness of the elastic fibers is not particularly limited and may be selected in accordance with the intended application of the product. The fineness is preferably in the range of 15 to 80 dtex, more preferably 20 to 60 dtex, and further preferably 30 to 50 dtex. When the fineness of the elastic yarn is less than 15 dtex, the required elongation and recoverability may not be obtained. Conversely, when the fineness exceeds 80 dtex, the basis weight becomes large, whereby the fabric may be too heavy as a garment.

The method for combining the core fibers and sheath fibers in the covered yarn is not particularly limited and any known method can be used. For example, a method such as covering or air-covering may be used.

The number of twists may also be appropriately selected in accordance with the intended application of the product. In general, a number of twists in the range of 500 to 2000 t/m is used.

A so-called rubber yarn, which is a yarn-like structure composed of a natural rubber, synthetic rubber, or semisynthetic rubber, can be used as the elastic fibers. A polyurethane elastic-yarn which is excellent in stretchability and which has been widely adopted is suitable, and a polyurethane elastic yarn composed of a polyurethane produced by the chain elongation reaction of a prepolymer, which has been prepared from polytetramethylene glycol and diphenylmethane-4,4-diisocyanate, with and ethylenediamine as chain elongation agent, is preferable.

The elastic circular-knitted fabric of the present embodiment is characterized in that in the elongation stress curves of the knitted fabric in the warp and weft directions, the ratio (a2/a1) of the slope (a1) at 0 to 40% elongation to the slope (a2) at 40 to 80% elongation is 1.0 or less in the respective directions and that the standard deviation of the unevenness between the loops on the rear surface of the knitted fabric is 0.5 or less.

In order to obtain an elastic circular-knitted fabric which follows the body and which has a suitable wear feeling, it is preferable to minimize this slope ratio (a2/a1). In conventional knitted fabrics, when the elongation exceeds 40%, before the elastic fibers become sufficiently elongated, the non-elastic fibers become taut, hindering the elongation of the elastic fibers, whereby the elongation of the knitted fabric is reduced. Thus, the stress at elongation increases, and the slope (a2) of the 40 to 80% elongation stress curve becomes larger than the slope of the 0 to 40% elongation stress curve.

In other words, by limiting this slope ratio (a2/a1) to 1.0 or less, a knitted fabric having stretchability, which does not feel tight, and which follows the body when worn as clothing can be obtained.

Further, by limiting the standard deviation of the unevenness between the loops in the rear surface of the knitted fabric to 0.5 or less, a knitted fabric having an excellent texture with minimal roughness can be obtained.

The standard deviation in the unevenness between the loops on the rear surface of the knitted fabric is the standard deviation of the coefficient of dynamic friction in one or both directions when reciprocating in the warp direction of the knitted fabric on the surface of the knitted fabric which directly touches the skin, i.e., the variation in the coefficient of dynamic friction, and is an index representing the degree of unevenness in the rear surface. When this value is large, since the degree of unevenness of the surface is large or the roughness number is large, the knitted fabric lacks smoothness and does not exhibit a smooth texture to the skin, whereby physical stimulation of the skin also increases, the texture is rough, and a suitable texture cannot be obtained. The phrase "rear surface of the knitted fabric" refers to the surface corresponding to the skin surface side when the knitted fabric of the present embodiment is used as a garment. Though either the inner surface or the outer surface of the circular knitted fabric may be the skin surface side, in the present embodiment, the standard deviation of the unevenness between the loops of the inner surface of the circular knitted fabric is 0.5 or less. Furthermore, the standard deviation of the unevenness between the loops of the rear surface of the knitted fabric of the present embodiment is measured by the method described in section (2) of the Examples below.

The smaller the value of the standard deviation of the unevenness between the loops of the rear surface, which directly contacts the skin, of the knitted fabric of the present embodiment decreases, the better the texture without roughness. The value of the standard deviation is preferably 0.3 or less, and more preferably 0.2 or less. If the value of the standard deviation of the unevenness between loops of the rear surface of the knitted fabric is excessively high, the physical sensation imparted to the skin becomes large, and as a result, not only does the texture deteriorate but also the skin may be damaged thereby, which is not preferable.

In other words, a slope ratio (a2/a1) of 1.0 or less and a standard deviation of the unevenness between the loops on the rear surface of the knitted fabric of 0.5 or less indicates a combination of both stretchability and texture.

The slopes (a1) of the stress curves at 0% to 40% elongation and the slopes (a2) of the stress curves at 40 to 80% elongation in the warp and weft directions are values which are obtained by measuring the forward path stress and return path stress of a first return trip during elongation recovery in which elongation to a rate of 80% in the warp direction and weft direction of a knitted fabric sample is repeated in a tensile test (in accordance with JIS-L-1096), and reading each of the amount of change in forward path stress between 0% elongation (prior to elongation) and 40% elongation and the amount of change in forward path stress between 40% elongation and 80% elongation, and can be calculated from the following Formulae (1) and (2):

$$a1\ (\text{cN}/\%)=(\text{stress cN at 40\% elongation}-\text{stress cN prior to elongation})/40\% \quad (1)$$

$$a2\ (\text{cN}/\%)=(\text{stress cN at 80\% elongation}-\text{stress cN at 40\% elongation})/40\% \quad (2).$$

Further, ratio of slope of elongation stress curve can be calculated from the following Formula (3):

$$\text{Ratio of slope of elongation stress curve}=a2/a1 \quad (3).$$

In the elastic circular-knitted fabric of the present embodiment, the yarn length index ratio of the knitted loops (c1) composed of non-elastic fibers and the knitted loops (c2) comprising elastic fibers is preferably 1.30 to 1.70. The yarn length index ratio is more preferably 1.30 to 1.65, further preferably 1.30 to 1.50, and particularly preferably 1.30 to 1.45.

If the yarn length index ratio of the knitted loops (c1) composed of non-elastic fibers and the knitted loops (c2) composed of non-elastic fibers and elastic fibers is less than 1.3, the non-elastic fibers will become taught prior to sufficient elongation of the elastic fibers, whereby the elongation of the elastic fibers is inhibited, the elongation of the knitted fabric is reduced, and when the knitted fabric is worn as clothing, tightness may be experienced, inhibiting movement. Conversely, if the yarn length index ratio of the knitted loops (c1) composed of non-elastic fibers and the knitted loops (c2) composed of non-elastic fibers and elastic fibers exceeds 1.7, though the elasticity of the knitted fabric is sufficient, the non-elastic fibers are present in the knitted fabric in an unnecessarily slacked state, whereby slack emerges on the surface of the knitted fabric, causing unevenness on the surface of the knitted fabric, which results in a feeling of roughness in the knitted fabric, degrading the texture thereof. Thus, it may be impossible to obtain a knitted fabric which combines both stretchability and texture.

In the present description, the "yarn length index ratio of the knitted loops (c1) composed of non-elastic fibers and the knitted loops (c2) composed of non-elastic fibers and elastic fibers" is a value obtained by extracting the non-elastic fibers (c1) and the knitted loops (c2) composed of non-elastic fibers and elastic fibers from a one-inch portion (wale-number portion) of the knitted fabric, suspending a load of 0.44 cN/dtex from each, measuring the lengths thereof, measuring the finenesses of each in accordance with JIS-L-1013, thereafter measuring the number of courses of the knitted fabric with a densimeter or the like, obtaining the individual yarn length indexes c1 and c2 from the following Formulae (4) and (5):

$$\text{yarn length index of } c1=(\text{length of one-inch knitted fabric}\times\text{number of courses of knitted fabric})\times\sqrt{(\text{fineness})} \quad (4)$$

$$\text{yarn length index of } c2=(\text{length of one-inch knitted fabric}\times\text{number of courses of knitted fabric})\times\sqrt{(\text{fineness})} \quad (5),$$

and thereafter calculating by the following Formula (6):

$$\text{yarn length index ratio}=c1/c2 \quad (6).$$

Knitted loops of elastic fibers or elastic fibers and non-elastic fibers, which form the same knitted loop, are selected as the knitted loops (c2) composed of non-elastic fibers and elastic fibers, which are the target of the yarn length and fineness measurements.

For example, when the non-elastic fibers and the elastic fibers are integral, as in a covered yarn (FTY), the yarn length and fineness of the fiber itself may be measured as the elastic fibers. In the case in which the non-elastic fibers and the elastic fibers can be separated, as in the case in which the non-elastic fibers and elastic fibers are plated, the yarn length and fineness of the non-elastic fibers may be measured. In the case in which the knitting structure differs depending on the course, the yarn length and fineness of c1 or c2 of a course having a short yarn length may be used.

In order to adjust the yarn length index ratio to within a predetermined range, the length of the knitted loops (c1) composed of non-elastic fibers in a one-inch portion of knitted fabric is preferably 9.0 to 14.0 cm, more preferably 10.0 to 13.0 cm, and further preferably 11.0 to 12.5 cm. Furthermore, the length of the knitted loops (c2) composed of non-elastic fibers and elastic fibers is preferably 12.5 to 15.0 cm, and more preferably 13.5 to 14.5 cm. It is preferable that the length of the knitted loops (c2) composed of non-elastic fibers and elastic fibers be greater than that of the knitted loops (c1) composed of non-elastic fibers.

The number of courses per one-inch knitted fabric differs depending on the fineness and yarn length used, but is preferably in the range of 60 to 90, more preferably 65 to 85, and further preferably 70 to 80. However, the number of courses is not limited thereto depending on the application of the clothing, and the number of courses may be set in accordance with purpose.

By setting the ratio of the fineness of the non-elastic fibers used in the knitted loops (c1) composed of non-elastic fibers and the fineness of the non-elastic fibers used in the knitted loops (c2) composed of non-elastic fibers and elastic fibers ({fineness ratio=(fineness of non-elastic fibers used in knitted loops (c1) composed of non-elastic fibers)/(fineness of non-elastic fibers used in knitted loops (c2) composed of non-elastic fibers and elastic fibers)}) of the elastic circular-knitted fabric of the present embodiment within a specific range, the yarn length index ratio can be preferably adjusted to within a provided range. The fineness ratio is preferably within the range of 2.0 to 4.0, more preferably 2.8 to 3.8.

In order to prevent clothes from becoming too heavy when worn, the fineness of the non-elastic fibers used in the knitted loops (c1) composed of non-elastic fibers is preferably 30 to 200 dtex in a filament yarn, more preferably 50 to 170 dtex, and further preferably 60 dtex to 140 dtex. Furthermore, in a spun yarn, the fineness is preferably No. 80 to No. 20, and more preferably No. 50 to No. 30. The fineness may be adjusted by aligning two or more fibers.

The fineness of the non-elastic fibers used in the knitted loops (c2) composed of non-elastic fibers and elastic fibers is preferably in the range of 15 to 100 dtex, more preferably 20 to 80 dtex, and further preferably 30 to 60 dtex. When the fineness of such non-elastic fibers is less than 15 dtex, the required extensibility and recoverability may not be obtained in some cases. Conversely, when the fineness exceeds 100 dtex, the basis weight becomes large, whereby the clothing may be too heavy when worn.

The single-yarn fineness of the non-elastic fibers used in the knitted loops (c1) composed of non-elastic fibers and the knitted loops (c2) composed of non-elastic fibers and elastic fibers is preferably 0.3 to 3.0 dtex, more preferably 0.5 to 25 dtex, and further preferably 0.8 to 2.3 dtex so as to not inhibit the stretchability of the elastic fibers and so as to provide a garment having a soft texture.

The slope (a2) of the stress curve of the elastic circular-knitted fabric of the present embodiment at 40 to 80% elongation in the warp direction is preferably 20 cN/% or less.

The slope (a2) of the stress curve at 40 to 80% elongation in the warp direction is preferably 9 to 17 cN/%, and more preferably 9 to 16 cN/%.

If the slope (a2) of the stress curve at 40% to 80% elongation in the warp direction exceeds 20 cN/%, when the loops in the warp direction of the knitted fabric on the surface of the knitted fabric that directly touches the skin reciprocate back and forth, it is believed that because the elongation of the knitted fabric is small and the stress is increased, resistance can be felt by the skin of the fingers or the skin surface, whereby the feeling of roughness is increased.

Since the maximum elongation of the skin is about 60%, it is important to reduce the slope of the stress curve at 40 to 80% elongation.

However, when the degree of unevenness of the knitted fabric is large, the texture becomes rough, whereby the texture deteriorates. Thus, it is preferable to reduce the slope of the stress curve at 40 to 80% elongation in the warp direction within the provided yarn length index ratio.

The basis weight of the elastic circular-knitted fabric of the present embodiment is preferably in the range of 80 to 300 g/m$^2$, more preferably 110 to 250 g/m$^2$, and further preferably 120 to 200 g/m$^2$. If the basis weight is less than 80 g/m$^2$, in some cases the opacity and rupture strength may be poor. Conversely, if the basis weight exceeds 300 g/m$^2$, the fabric is excessively heavy when worn, which may inhibit movement.

The elastic circular knitted fabric of the present embodiment can be knitted by a flat-knitting machine, a single circular-knitting machine, or a double circular-knitting machine, and is not particularly limited as long as a basis weight and organization texture suitable for the intended purpose can be obtained.

Though the gauge of the knitting machine is also not particularly limited, an 18 to 40-gauge knitting machine can be arbitrarily selected depending on application and the thickness of the fibers to be used. The gauge is more preferably 22 to 32-gauge, and further preferably 24 to 28-gauge.

Examples of the knitting structure include a jersey stitch, inlay stitch, smooth stitch, and circular rib stitch. However, the knitting structure is not limited thereto. A yarn arrangement such as a seed knit, honeycomb, or mesh may be used. In garments which directly touch the skin, such as underwear, a fit to the body is preferred. Thus, in order to enhance the stretching and fitting feelings, a plain stitch structure comprising elastic fibers is preferable.

Further, fibers having desired properties to be imparted may be used as the non-elastic fibers. For example, if it is desired to impart moisture absorbing and releasing properties to the knitted fabric, a cellulose fiber can be used. In the form of filament yarn, this cellulose fiber may be any of an original yarn (raw yarn), a false twisted yarn, or a pre-dyed yarn, or furthermore may be a composite yarn, polyester fibers, or polyamide fibers. The non-elastic fibers may be spun yarns, and may also be yarns blended with polyester fibers or polyamide fibers. A cupra fiber is preferable as the cellulose fiber.

EXAMPLES

The present invention will be more specifically described below by way of the Examples.

The evaluations of the Examples were performed as described below.

(1) Stretchability (1-1) Extensibility

A knitted fabric sample (200 mm×200 mm) is grasped in two places (grasping interval of 50 mm), a tensile force is imparted thereto, and the elongation rate at maximum load is measured.

The tensile speed is 0.1 mm/sec. The tensile elongation amount is 50 mm/10 V. The maximum tensile load is 1 kgf (50 gf/cm). The measurement temperature is 20° C. at a humidity of 65% RH. Measurement is preformed in the warp direction and the weft direction.

(1-2) Elongation Recoverability

In tensile tests (in accordance with JIS-L-1096) in the warp direction and weft direction of the knitted fabric sample, the forward path stress and return path stress are measured in elongation recovery in which elongation to a rate of 80% is repeatedly performed, the residual elongation (%) after a third elongation recovery is read from the obtained elongation recovery curve, and the following Formula (7) is calculated:

$$\text{elongation recovery rate (\%)}=\{[(80\%-(\text{residual elongation (\%)}))/80\%]\times 100\} \quad (7).$$

(2) Standard Deviation of Unevenness Between Loops of Knitted Fabric Rear Surface (Texture)

Testing is performed using a static/dynamic friction measurement device TL201 Ts (manufactured by Trinity Labs, Co., Ltd.; oscillating table-type).

A knitted fabric sample is cut to a width of 5 cm and a length (warp) of 25 cm, and the knitted fabric sample is fixed, with the surface corresponding to the skin facing upwards, in a 2% elongation state to the surface of the measurement device using an awl. A 1.5 $cm^2$ tactile contact (a contact having a hardness equivalent to a fingertip) is used as the contactor, a load of 3.75 g is applied thereto, and the contact is reciprocated three times in the warp direction at a moving distance of 10 cm. The moving rate is 30 mm/s. The standard deviation of the dynamic coefficient of friction within 10 cm movement is obtained for each type of friction in both directions for three reciprocating movements. The average value of the three reciprocating values in the forward/backward directions is calculated and used as the evaluation value.

(3) Wear Feeling

T-shirts made from a prototype knitted fabric are worn by 10 monitors under an environment of 28° C. and 60% RH. Ease of movement at the time of wearing, texture at the time of removal and wearing, and the presence of roughness are comprehensively evaluated. Sensory evaluation regarding comfort (wear feeling) is carried out within a total of nine evaluation levels, including the following five levels and half-points for each level (for example, an evaluation between "5: Excellent" and "4: Good" is "4.5"). The average of these values is taken as the evaluation result.

5: Excellent
4: Good
3: Cannot Decide
2: Not Good
1: Poor

Example 1

A 1:1 mixed knit grey fabric having a plain stitch structure was produced using a 28-gauge single circular knitting machine, using a composite fiber composed of 66 dtex 43 f cupra and 56 dtex 48 f nylon in the knitted loops (c1) composed of non-elastic fibers, and using a covered yarn, in which a 33 dtex (draft rate 3.0-fold) polyurethane elastic fiber composed of a prepolymer using polytetramethylene glycol was covered with 33 dtex 24 f nylon, in the knitted loops (c2) composed of non-elastic fibers and elastic fibers, wherein the yarn length of the knitted loops composed of the non-elastic fibers was 295 mm/100 w and the yarn length of the knitted loops comprising elastic fibers was 345 mm/100 w. This grey fabric was passed through an 80° C. hot water layer, and thereafter presetting was executed under conditions of 195° C.×60 second. Thereafter, dyeing and finishing processes were carried out under conditions of conventional elastic circular-knitted fabrics, whereby a knitted fabric having a basis weight of 136 g/$m^2$, a number of courses of 70, and a wale number of 44 was obtained.

Regarding the obtained knitted fabric, the yarn length index ratio of the knitted loops (c1) composed of non-elastic fibers to the knitted loops (c2) composed of non-elastic fibers and elastic fibers was 1.42, the ratios (a2/a1) of the slope (a1) at 0 to 40% elongation to the slope (a2) at 40 to 80% elongation in the elongation stress curves in the warp and weft directions, were 0.83 in the warp direction and 0.84 in the weft direction, the slope (a2) of the stress curve at 40 to 80% elongation in the warp direction was 11.0 cN/%, and the standard deviation of the unevenness between the loops of the rear surface of the knitted fabric was 0.191. The obtained circular-knitted fabric was excellent in elongation properties and the knitted fabric rear surface thereof had minimal roughness. Thus, the obtained circular-knitted fabric combined both stretchability and texture.

Example 2

A 1:1 mixed knit grey fabric having a plain stitch structure was produced using a 28-gauge single circular knitting machine, using a composite fiber composed of 66 dtex 43 f cupra and 33 dtex 10 f nylon in the knitted loops (c1) composed of non-elastic fibers, and using a covered yarn, in which a 33 dtex (draft rate 3.0-fold) polyurethane elastic fiber composed of a prepolymer using polytetramethylene glycol was covered with 33 dtex 24 f nylon, in the knitted loops (c2) composed of non-elastic fibers and elastic fibers, wherein the yarn length of the knitted loops composed of the non-elastic fibers was 295 mm/100 w and the yarn length of the knitted loops comprising elastic fibers was 345 mm/100 w. This grey fabric was treated in the same manner as Example 1 to obtain a knitted fabric having a basis weight of 120 g/$m^2$, a number of courses of 76, and a wale number of 43.

Regarding the obtained knitted fabric, the yarn length index ratio of the knitted loops (c1) composed of non-elastic fibers to the knitted loops (c2) composed of non-elastic fibers and elastic fibers was 1.30, the ratios (a2/a1) of the slope (a1) at 0 to 40% elongation to the slope (a2) at 40 to 80% elongation in the elongation stress curves in the warp and weft directions, were 0.84 in the warp direction and 0.71 in the weft direction, the slope (a2) of the stress curve at 40 to 80% elongation in the warp direction was 13.2 cN/%, and the standard deviation of the unevenness between the loops of the rear surface of the knitted fabric was 0.180. The obtained circular-knitted fabric was excellent in elongation properties and the knitted fabric rear surface thereof had minimal roughness. Thus, the obtained circular-knitted fabric combined both stretchability and texture.

Example 3

A 1:1 mixed knit grey fabric having a plain stitch structure was produced using a 28-gauge single circular knitting machine, using a mixed filament yarn of 110 dtex 48 f polyester and 22 dtex 24 f polyester in the knitted loops (c1) composed of non-elastic fibers, and using a covered yarn, in which a 33 dtex (draft rate 3.0-fold) polyurethane elastic fiber composed of a prepolymer using polytetramethylene glycol was covered with 33 dtex 24 f nylon, in the knitted loops (c2) composed of non-elastic fibers and elastic fibers, wherein the yarn length of the knitted loops composed of the non-elastic fibers was 295 mm/100 w and the yarn length of the knitted loops comprising elastic fibers was 345 mm/100 w. This grey fabric was treated in the same manner as Example 1 to obtain a knitted fabric having a basis weight of 170 g/$m^2$, a number of courses of 77, and a wale number of 44.

Regarding the obtained knitted fabric, the yarn length index ratio of the knitted loops (c1) composed of non-elastic fibers to the knitted loops (c2) composed of non-elastic fibers and elastic fibers was 1.41, the ratios (a2/a1) of the slope (a1) at 0 to 40% elongation to the slope (a2) at 40 to 80% elongation in the elongation stress curves in the warp and weft directions, were 0.82 in the warp direction and 0.85 in the weft direction, the slope (a2) of the stress curve at 40 to 80% elongation in the warp direction was 9.3 cN/%, and the standard deviation of the unevenness between the loops of the rear surface of the knitted fabric was 0.183. The obtained circular-knitted fabric was excellent in elongation properties and the knitted fabric rear surface thereof had minimal roughness. Thus, the obtained circular-knitted fabric combined both stretchability and texture.

Example 4

A 1:1 mixed knit grey fabric having a plain stitch structure was produced using a 28-gauge single circular knitting machine, using a mixed filament yarn of 78 dtex 68 f nylon and 56 dtex 48 f nylon in the knitted loops (c1) composed of non-elastic fibers, and using a covered yarn, in which a 33 dtex (draft rate 3.0-fold) polyurethane elastic fiber composed of a prepolymer using polytetramethylene glycol was covered with 33 dtex 24 f nylon, in the knitted loops (c2) composed of non-elastic fibers and elastic fibers, wherein the yarn length of the knitted loops composed of the non-elastic fibers was 295 mm/100 w and the yarn length of the knitted loops comprising elastic fibers was 345 mm/100 w. This grey fabric was treated in the same manner as Example 1 to obtain a knitted fabric having a basis weight of 152 g/m$^2$, a number of courses of 83, and a wale number of 40.

Regarding the obtained knitted fabric, the yarn length index ratio of the knitted loops (c1) composed of non-elastic fibers to the knitted loops (c2) composed of non-elastic fibers and elastic fibers was 1.43, the ratios (a2/a1) of the slope (a1) at 0 to 40% elongation to the slope (a2) at 40 to 80% elongation in the elongation stress curves in the warp and weft directions, were 1.00 in the warp direction and 0.96 in the weft direction, the slope (a2) of the stress curve at 40 to 80% elongation in the warp direction was 16.2 cN/%, and the standard deviation of the unevenness between the loops of the rear surface of the knitted fabric was 0.189. The obtained circular-knitted fabric was excellent in elongation properties and the knitted fabric rear surface thereof had minimal roughness. Thus, the obtained circular-knitted fabric combined both stretchability and texture.

Example 5

A 1:1 mixed knit grey fabric having a single-side-plated plain stitch structure was produced using a 28-gauge single circular knitting machine, using a composite fiber composed of 66 dtex 43 f nylon and 56 dtex 48 f nylon in the knitted loops (c1) composed of non-elastic fibers, and using a plated yarn, in which 33 dtex 24 f nylon was plated with a 33 dtex (draft rate 3.0-fold) polyurethane elastic fiber composed of a prepolymer using polytetramethylene glycol, in the knitted loops (c2) composed of non-elastic fibers and elastic fibers, wherein the yarn length of the knitted loops composed of the non-elastic fibers was 295 mm/100 w and the yarn length of the knitted loops comprising elastic fibers was 345 mm/100 w. This grey fabric was treated in the same manner as Example 1 to obtain a knitted fabric having a basis weight of 130 g/m$^2$, a number of courses of 69, and a wale number of 42.

Regarding the obtained knitted fabric, the yarn length index ratio of the knitted loops (c1) composed of non-elastic fibers to the knitted loops (c2) composed of non-elastic fibers and elastic fibers was 1.67, the ratios (a2/a1) of the slope (a1) at 0 to 40% elongation to the slope (a2) at 40 to 80% elongation in the elongation stress curves in the warp and weft directions, were 0.91 in the warp direction and 0.88 in the weft direction, the slope (a2) of the stress curve at 40 to 80% elongation in the warp direction was 12.4 cN/%, and the standard deviation of the unevenness between the loops of the rear surface of the knitted fabric was 0.254. The obtained circular-knitted fabric was excellent in elongation properties and the knitted fabric rear surface thereof had minimal roughness. Thus, the obtained circular-knitted fabric combined both stretchability and texture.

Example 6

A 1:1 mixed knit grey fabric having a plain stitch structure was produced using a 28-gauge single circular knitting machine, using a 167 dtex 90 f cupra in the knitted loops (c1) composed of non-elastic fibers, and using a covered yarn, in which a 33 dtex (draft rate 3.0-fold) polyurethane elastic fiber composed of a prepolymer using polytetramethylene glycol was covered with 33 dtex 24 f nylon, in the knitted loops (c2) composed of non-elastic fibers and elastic fibers, wherein the yarn length of the knitted loops composed of the non-elastic fibers was 260 mm/100 w and the yarn length of the knitted loops comprising elastic fibers was 345 mm/100 w. This grey fabric was treated in the same manner as Example 1 to obtain a knitted fabric having a basis weight of 180 g/m$^2$, a number of courses of 67, and a wale number of 40.

Regarding the obtained knitted fabric, the yarn length index ratio of the knitted loops (c1) composed of non-elastic fibers to the knitted loops (c2) composed of non-elastic fibers and elastic fibers was 1.49, the ratios (a2/a1) of the slope (a1) at 0 to 40% elongation to the slope (a2) at 40 to 80% elongation in the elongation stress curves in the warp and weft directions, were 0.99 in the warp direction and 0.98 in the weft direction, the slope (a2) of the stress curve at 40 to 80% elongation in the warp direction was 13.6 cN/%, and the standard deviation of the unevenness between the loops of the rear surface of the knitted fabric was 0.261. The obtained circular-knitted fabric was excellent in elongation properties and the knitted fabric rear surface thereof had minimal roughness. Thus, the obtained circular-knitted fabric combined both stretchability and texture.

Example 7

A 1:1 mixed knit grey fabric having a plain stitch structure was produced using a 32-gauge single circular knitting machine, using a 84 dtex 36 f polyester in the knitted loops (c1) composed of non-elastic fibers, and using a covered yarn, in which a 22 dtex (draft rate 3.0-fold) polyurethane elastic fiber composed of a prepolymer using polytetramethylene glycol was covered with 22 dtex 24 f polyester, in the knitted loops (c2) composed of non-elastic fibers and elastic fibers, wherein the yarn length of the knitted loops composed of the non-elastic fibers was 250 mm/100 w and the yarn length of the knitted loops comprising elastic fibers was 300 mm/100 w. This grey fabric was treated in the same manner as Example 1 to obtain a knitted fabric having a basis weight of 122 g/m$^2$, a number of courses of 78, and a wale number of 46.

Regarding the obtained knitted fabric, the yarn length index ratio of the knitted loops (c1) composed of non-elastic fibers to the knitted loops (c2) composed of non-elastic fibers and elastic fibers was 1.50, the ratios (a2/a1) of the slope (a1) at 0 to 40% elongation to the slope (a2) at 40 to 80% elongation in the elongation stress curves in the warp and weft directions, were 0.88 in the warp direction and 0.88 in the weft direction, the slope (a2) of the stress curve at 40 to 80% elongation in the warp direction was 11.9 cN/%, and the standard deviation of the unevenness between the loops of the rear surface of the knitted fabric was 0.215. The obtained circular-knitted fabric was excellent in elongation properties and the knitted fabric rear surface thereof had minimal roughness. Thus, the obtained circular-knitted fabric combined both stretchability and texture.

Example 8

A 1:1 mixed knit grey fabric having a plain stitch structure was produced using a 28-gauge single circular knitting machine, using a composite fiber composed of a 66 dtex 43 f cupra and a 56 dtex 48 f nylon in the knitted loops (c1) composed of non-elastic fibers, and using a covered yarn, in which a 33 dtex (draft rate 3.0-fold) polyurethane elastic fiber composed of a prepolymer using polytetramethylene glycol was covered with 33 dtex 24 f nylon, in the knitted loops (c2) composed of non-elastic fibers and elastic fibers, wherein the yarn length of the knitted loops composed of the non-elastic fibers was 285 mm/100 w and the yarn length of the knitted loops comprising elastic fibers was 355 mm/100 w. This grey fabric was treated in the same manner as Example 1 to obtain a knitted fabric having a basis weight of 127 g/m$^2$, a number of courses of 67, and a wale number of 43.

Regarding the obtained knitted fabric, the yarn length index ratio of the knitted loops (c1) composed of non-elastic fibers to the knitted loops (c2) composed of non-elastic fibers and elastic fibers was 1.28, the ratios (a2/a1) of the slope (a1) at 0 to 40% elongation to the slope (a2) at 40 to 80% elongation in the elongation stress curves in the warp and weft directions, were 0.96 in the warp direction and 0.98 in the weft direction, the slope (a2) of the stress curve at 40 to 80% elongation in the warp direction was 13.1 cN/%, and the standard deviation of the unevenness between the loops of the rear surface of the knitted fabric was 0.248. The obtained circular-knitted fabric was excellent in elongation properties and the knitted fabric rear surface thereof had minimal roughness. Thus, the obtained circular-knitted fabric combined both stretchability and texture.

Example 9

A 1:1 mixed knit grey fabric having a plain stitch structure was produced using a 28-gauge single circular knitting machine, using a composite fiber composed of a 66 dtex 43 f cupra and a 56 dtex 48 f nylon in the knitted loops (c1) composed of non-elastic fibers, and using a covered yarn, in which a 22 dtex (draft rate 3.0-fold) polyurethane elastic fiber composed of a prepolymer using polytetramethylene glycol was covered with 22 dtex 20 f nylon, in the knitted loops (c2) composed of non-elastic fibers and elastic fibers, wherein the yarn length of the knitted loops composed of the non-elastic fibers was 295 mm/100 w and the yarn length of the knitted loops comprising elastic fibers was 340 mm/100 w. This grey fabric was treated in the same manner as Example 1 to obtain a knitted fabric having a basis weight of 124 g/m$^2$, a number of courses of 71, and a wale number of 44.

Regarding the obtained knitted fabric, the yarn length index ratio of the knitted loops (c1) composed of non-elastic fibers to the knitted loops (c2) composed of non-elastic fibers and elastic fibers was 1.72, the ratios (a2/a1) of the slope (a1) at 0 to 40% elongation to the slope (a2) at 40 to 80% elongation in the elongation stress curves in the warp and weft directions, were 0.72 in the warp direction and 0.85 in the weft direction, the slope (a2) of the stress curve at 40 to 80% elongation in the warp direction was 9.5 cN/%, and the standard deviation of the unevenness between the loops of the rear surface of the knitted fabric was 0.375. The obtained circular-knitted fabric was excellent in elongation properties and the knitted fabric rear surface thereof had minimal roughness. Thus, the obtained circular-knitted fabric combined both stretchability and texture.

Comparative Example 1

A 1:1 bare plain stitch structure was produced using a 28-gauge single circular-knitting machine, using a composite fiber composed of 66 dtex 43 f cupra and 36 dtex 26 f nylon and a 78 dtex 68 f nylon in the non-elastic fibers arranged for every course, and using a 22 dtex (draft rate 3.0-fold) polyurethane elastic fiber composed of a prepolymer using polytetramethylene glycol in the elastic fibers for all of the courses, wherein the yarn length of the non-elastic fibers was 270 mm/100 w. This grey fabric was passed through an 80° C. hot water layer, and thereafter presetting was executed under conditions of 198° C.×60 seconds. Thereafter, dyeing and finishing processes were carried out under conditions of conventional elastic circular-knitted fabrics, whereby a knitted fabric having a basis weight of 139 g/m$^2$, a number of courses of 74, and a wale number of 46 was obtained.

Regarding the obtained knitted fabric, the yarn length index ratio of the knitted loops (c1) composed of non-elastic fibers to the knitted loops (c2) composed of non-elastic fibers and elastic fibers was 1.20, the ratios (a2/a1) of the slope (a1) at 0 to 40% elongation to the slope (a2) at 40 to 80% elongation in the elongation stress curves in the warp and weft directions, were 2.17 in the warp direction and 1.02 in the weft direction, the slope (a2) of the stress curve at 40 to 80% elongation in the warp direction was 35.4 cN/%, and the standard deviation of the unevenness between the loops of the rear surface of the knitted fabric was 0.520. The obtained circular-knitted fabric was lacking in elongation properties, was tight when worn, and the knitted fabric rear surface thereof was rough. Thus, the obtained circular-knitted fabric could not combine both stretchability and texture.

Comparative Example 2

A 1:1 bare plain stitch structure was produced using a 28-gauge single circular-knitting machine, using a composite fiber composed of 66 dtex 43 f cupra and 36 dtex 26 f nylon and a 78 dtex 68 f nylon in the non-elastic fibers arranged for every course, and using a 22 dtex (draft rate 3.0-fold) polyurethane elastic fiber composed of a prepolymer using polytetramethylene glycol in the elastic fibers for all of the courses, wherein the yarn length of the non-elastic fibers was 270 mm/100 w, and the yarn length of the 78 dtex nylon was set to 285 mm/100 w in consideration of shrinkage in boiling water. This grey fabric was passed through an 80° C. hot water layer, and thereafter presetting was executed under conditions of 198° C.×60 seconds. Thereafter, dyeing and finishing processes were carried out under conditions of conventional elastic circular-knitted fabrics, whereby a knitted fabric having a basis weight of 143 g/m$^2$, a number of courses of 74, and a wale number of 44 was obtained.

Regarding the obtained knitted fabric, the yarn length index ratio of the knitted loops (c1) composed of non-elastic fibers to the knitted loops (c2) composed of non-elastic fibers and elastic fibers was 1.12, the ratios (a2/a1) of the slope (a1) at 0 to 40% elongation to the slope (a2) at 40 to 80% elongation in the elongation stress curves in the warp and weft directions, were 2.52 in the warp direction and 1.35 in the weft direction, the slope (a2) of the stress curve at 40 to 80% elongation in the warp direction was 37.7 cN/%, and the standard deviation of the unevenness between the loops of the rear surface of the knitted fabric was 0.493. Though the unevenness between the loops of the rear surface of the knitted fabric was improved, the obtained circular-knitted fabric slightly lacked elongation and was tight when worn. Thus, the obtained circular-knitted fabric could not combine both stretchability and texture.

Comparative Example 3

A 1:1 mixed knit grey fabric having a plain stitch structure was produced using a 28-gauge single circular knitting machine, using a composite fiber composed of a 66 dtex 43 f cupra and a 56 dtex 48 f nylon in the knitted loops (c1) composed of non-elastic fibers, and using a covered yarn, in which a 33 dtex (draft rate 3.0-fold) polyurethane elastic fiber composed of a prepolymer using polytetramethylene glycol was covered with 33 dtex 24 f nylon, in the knitted loops (c2) composed of non-elastic fibers and elastic fibers, wherein the yarn length of the knitted loops composed of the non-elastic fibers was 240 mm/100 w and the yarn length of the knitted loops comprising elastic fibers was 335 mm/100 w. This grey fabric was passed through an 80° C. hot water layer, and thereafter presetting was executed under conditions of 195° C.×60 seconds. Thereafter, dyeing and finishing processes were carried out under conditions of conventional elastic circular-knitted fabrics, whereby a knitted fabric having a basis weight of 133 g/m$^2$, a number of courses of 73, and a wale number of 42 was obtained.

Regarding the obtained knitted fabric, the yarn length index ratio of the knitted loops (c1) composed of non-elastic fibers to the knitted loops (c2) composed of non-elastic fibers and elastic fibers was 1.18, the ratios (a2/a1) of the slope (a1) at 0 to 40% elongation to the slope (a2) at 40 to 80% elongation in the elongation stress curves in the warp and weft directions, were 1.51 in the warp direction and 0.97 in the weft direction, the slope (a2) of the stress curve at 40 to 80% elongation in the warp direction was 22.3 cN/%, and the standard deviation of the unevenness between the loops of the rear surface of the knitted fabric was 0.383. The obtained circular-knitted fabric was slightly lacking in elongation properties and was tight when worn. Thus, the obtained circular-knitted fabric could not combine both stretchability and texture.

Comparative Example 4

A 1:1 mixed knit grey fabric having a plain stitch structure was produced using a 28-gauge single circular knitting machine, using polyester and a cotton blend No. 40 yarn in the knitted loops (c1) composed of non-elastic fibers, and using a covered yarn, in which a 33 dtex (draft rate 3.0-fold) polyurethane elastic fiber composed of a prepolymer using polytetramethylene glycol was covered with 90 dtex 60 f cupra, in the knitted loops (c2) composed of non-elastic fibers and elastic fibers, wherein the yarn length of the knitted loops composed of the non-elastic fibers was 295 mm/100 w and the yarn length of the knitted loops comprising elastic fibers was 270 mm/100 w. This grey fabric was passed through an 80° C. hot water layer, and thereafter presetting was executed under conditions of 195° C.×60 seconds. Thereafter, dyeing and finishing processes were carried out under conditions of conventional elastic circular-knitted fabrics, whereby a knitted fabric having a basis weight of 140 g/m$^2$, a number of courses of 66, and a wale number of 48 was obtained.

Regarding the obtained knitted fabric, the yarn length index ratio of the knitted loops (c1) composed of non-elastic fibers to the knitted loops (c2) composed of non-elastic fibers and elastic fibers was 1.23, the ratios (a2/a1) of the slope (a1) at 0 to 40% elongation to the slope (a2) at 40 to 80% elongation in the elongation stress curves in the warp and weft directions, were 1.57 in the warp direction and 0.79 in the weft direction, the slope (a2) of the stress curve at 40 to 80% elongation in the warp direction was 29.6 cN/%, and the standard deviation of the unevenness between the loops of the rear surface of the knitted fabric was 0.393. The obtained circular-knitted fabric was slightly lacking in elongation properties and was tight when worn. Thus, the obtained circular-knitted fabric could not combine both stretchability and texture.

Comparative Example 5

A 1:1 mixed knit grey fabric having a plain stitch structure was produced using a 28-gauge single circular knitting machine, using a mixed filament yarn of 78 dtex 68 f nylon and 56 dtex 48 f nylon in the knitted loops (c1) composed of non-elastic fibers, and using a covered yarn, in which a 33 dtex (draft rate 3.0-fold) polyurethane elastic fiber composed of a prepolymer using polytetramethylene glycol was covered with 33 dtex 24 f nylon, in the knitted loops (c2) composed of non-elastic fibers and elastic fibers, wherein the yarn length of the knitted loops composed of the non-elastic fibers was 295 mm/100 w and the yarn length of the knitted loops comprising elastic fibers was 290 mm/100 w. This grey fabric was passed through an 80° C. hot water layer, and thereafter presetting was executed under conditions of 195° C.×60 seconds. Thereafter, dyeing and finishing processes were carried out under conditions of conventional elastic circular-knitted fabrics, whereby a knitted fabric having a basis weight of 135 g/m$^2$, a number of courses of 70 and a wale number of 44 was obtained.

Regarding the obtained knitted fabric, the yarn length index ratio of the knitted loops (c1) composed of non-elastic fibers to the knitted loops (c2) composed of non-elastic fibers and elastic fibers was 1.79, the ratios (a2/a1) of the slope (a1) at 0 to 40% elongation to the slope (a2) at 40 to 80% elongation in the elongation stress curves in the warp and weft directions, were 1.89 in the warp direction and 0.98 in the weft direction, the slope (a2) of the stress curve at 40 to 80% elongation in the warp direction was 29.4 cN/%, and the standard deviation of the unevenness between the loops of the rear surface of the knitted fabric was 0.542. The obtained circular-knitted fabric was slightly lacking in elongation properties and was tight when worn. Furthermore, the rear surface of the knitted fabric was rough. Thus, the obtained circular-knitted fabric could not combine both stretchability and texture.

TABLE 1-1

| | Yarn Used | | Knitting Machine | Stitch Organization | Fineness (dtex) | | Fineness Ratio | Basis weight | Density | | Set Yarn Length (mm/100 W) | | Knitting Pu Draft Rate | Product Yarn Length | | Yarn Length Index | | Yarn Length Index Ratio |
|---|---|---|---|---|---|---|---|---|---|---|---|---|---|---|---|---|---|---|
| | c1 | c2 | | | c1 | c2 | c1/c2 | (g/m$^2$) | C | W | c1 | c2 | Pu | c1 | c2 | c1 | c2 | c1/c2 |
| Example 1 | 122T91 (Cu66T43 + Ny56T48) | FTY-Pu33T × Ny33T24 | 28G | FTY Plain Stitch 1:1 Mixed-Knit | 127 | 47 | 2.7 | 136 | 70 | 44 | 295 | 345 | — | 12.4 | 14.3 | 9756 | 6859 | 1.42 |
| Example 2 | 99T53 (Cu66T43 + Ny33T10) | FTY-Pu33T × Ny33T24 | 28G | FTY Plain Stitch 1:1 Mixed-Knit | 103 | 47 | 2.2 | 120 | 76 | 43 | 295 | 345 | — | 12.3 | 14.0 | 9451 | 7296 | 1.30 |
| Example 3 | 132T72 (Pe110T48 + Pe22T24) | FTY-Pu33T × Ny33T24 | 28G | FTY Plain Stitch 1:1 Mixed-Knit | 137 | 47 | 2.9 | 170 | 77 | 44 | 295 | 345 | — | 12.0 | 14.5 | 10781 | 7652 | 1.41 |
| Example 4 | 134T116 (Ny78T68 + Ny56T48) | FTY-Pu33T × Ny33T24 | 28G | FTY Plain Stitch 1:1 Mixed-Knit | 139 | 47 | 3.0 | 152 | 83 | 40 | 295 | 345 | — | 10.5 | 12.6 | 10292 | 7184 | 1.43 |
| Example 5 | 122T91 (Cu66T43+ Ny56T48) | Ny33T24 × Pu33T | 28G | Bare Knit 1:1 Mixed-Knit (Pu Single-Side Plated) | 127 | 36 | 3.5 | 130 | 69 | 42 | 295 | 345 | 3.0 | 11.9 | 13.4 | 9271 | 5552 | 1.67 |
| Example 6 | Cu167T90 | FTY-Pu33T × Ny33T24 | 28G | FTY Plain Stitch 1:1 Mixed-Knit | 174 | 47 | 3.7 | 180 | 67 | 40 | 260 | 345 | — | 9.6 | 12.4 | 8512 | 5707 | 1.49 |
| Example 7 | Pe84T36 | FTY-Pu22T × Pe22T24 | 32G | FTY Plain Stitch 1:1 Mixed-Knit | 87 | 31 | 2.8 | 122 | 78 | 46 | 250 | 300 | — | 11.1 | 12.3 | 8082 | 5388 | 1.50 |
| Example 8 | 122T91 (Cu66T43 + Ny56T48) | FTY-Pu33T × Ny33T24 | 28G | FTY Plain Stitch 1:1 Mixed-Knit | 127 | 47 | 2.7 | 127 | 67 | 43 | 285 | 355 | — | 11.6 | 14.9 | 8762 | 6848 | 1.28 |
| Example 9 | 122T91 (Cu66T43 + Ny56T48) | FTY-Pu22T × Ny22T20 | 28G | FTY Plain Stitch 1:1 Mixed-Knit | 127 | 32 | 4.0 | 124 | 71 | 44 | 295 | 340 | — | 12.5 | 14.5 | 10034 | 5832 | 1.72 |
| Comp. Ex 1 | 102T69 (Cu66T43 + Ny56T48) + Pu22T | Ny78T68 × Pu22T | 28G | Bear Stitch 1:1 Mixed-Knit (Pu All Openings) | 106 | 86 | 1.2 | 139 | 74 | 46 | 270 | 270 | 3.0 | 11.1 | 10.4 | 8484 | 7094 | 1.20 |
| Comp. Ex 2 | 102T69 (Cu66T43 + Ny36T26) + Pu22T | Ny78T68 × Pu22T | 28G | Bear Stitch 1:1 Mixed-Knit (Pu All Openings) | 106 | 86 | 1.2 | 143 | 74 | 44 | 270 | 285 | 3.0 | 10.6 | 10.5 | 8048 | 7166 | 1.12 |
| Comp. Ex 3 | 122T91 (Cu66T4 3+ Ny56T48) | FTY-Pu33T × Ny33T24 | 28G | FTY Plain Stitch 1:1 Mixed-Knit | 127 | 47 | 2.7 | 133 | 73 | 42 | 240 | 335 | — | 9.7 | 13.4 | 7943 | 6740 | 1.18 |
| Comp. Ex 4 | TC40/– | FTY-Pu33T × Cu90T60 | 28G | FTY Plain Stitch 1:1 Mixed-Knit | 138 | 112 | 1.2 | 140 | 66 | 48 | 295 | 270 | — | 13.6 | 12.4 | 10584 | 8632 | 1.23 |

TABLE 1-1-continued

| | Yarn Used | | Knitting Machine | Stitch Organization | Fineness (dtex) | | Fineness Ratio | Basis weight | Density | | Set Yarn Length (mm/100 W) | | Knitting Pu Draft Rate | Product Yarn Length | | Yarn Length Index | | Yarn Length Index Ratio |
|---|---|---|---|---|---|---|---|---|---|---|---|---|---|---|---|---|---|---|
| | c1 | c2 | | | c1 | c2 | c1/c2 | (g/m$^2$) | C | W | c1 | c2 | Pu | c1 | c2 | c1 | c2 | c1/c2 |
| Comp. Ex 5 | 134T116 (Ny78T68 + Ny56T48) | FTY-Pu33T × Ny33T24 | 28G | FTY Plain Stitch 1:1 Mixed-Knit | 139 | 47 | 3.0 | 135 | 70 | 44 | 295 | 290 | — | 12.3 | 11.8 | 10168 | 5670 | 1.79 |

TABLE 1-2

| | 80% Elongation Stress | | Recovery Rate (%) | | Elongation Slope (cN/%) | | | | Slope Ratio (a2/a1) | | Roughness Standard Deviation | |
|---|---|---|---|---|---|---|---|---|---|---|---|---|
| | | | | | a1 | a2 | a1 | a2 | | | | |
| | Warp | Weft | Warp | Weft | Warp 0-40 | Warp 40-80 | Weft 0-40 | Weft 40-80 | Warp | Weft | (Texture, σ) | Wear Feeling |
| Example 1 | 1012 | 737 | 88 | 92 | 13.3 | 11.0 | 9.8 | 8.3 | 0.83 | 0.84 | 0.191 | 4.5 |
| Example 2 | 1341 | 1078 | 86 | 82 | 15.7 | 13.2 | 16.0 | 11.3 | 0.84 | 0.71 | 0.180 | 4.5 |
| Example 3 | 1164 | 1088 | 90 | 92 | 11.3 | 9.3 | 15.2 | 13.0 | 0.82 | 0.85 | 0.183 | 4.5 |
| Example 4 | 850 | 1152 | 86 | 87 | 16.3 | 16.2 | 13.6 | 13.0 | 1.00 | 0.96 | 0.189 | 4.5 |
| Example 5 | 1015 | 810 | 90 | 91 | 13.6 | 12.4 | 10.5 | 9.3 | 0.91 | 0.88 | 0.254 | 4.0 |
| Example 6 | 1072 | 1021 | 87 | 93 | 13.7 | 13.6 | 12.7 | 12.5 | 0.99 | 0.98 | 0.261 | 4.0 |
| Example 7 | 995 | 803 | 85 | 90 | 13.5 | 11.9 | 10.5 | 9.2 | 0.88 | 0.88 | 0.215 | 4.0 |
| Example 8 | 1051 | 970 | 87 | 90 | 13.7 | 13.1 | 12.1 | 11.9 | 0.96 | 0.98 | 0.248 | 3.5 |
| Example 9 | 880 | 760 | 86 | 89 | 13.2 | 9.5 | 10.0 | 8.5 | 0.72 | 0.85 | 0.375 | 3.5 |
| Comp. Ex. 1 | 2089 | 1052 | 94 | 98 | 16.3 | 35.4 | 13.0 | 13.2 | 2.17 | 1.02 | 0.520 | 2.5 |
| Comp. Ex. 2 | 2042 | 860 | 94 | 98 | 15.0 | 37.7 | 8.7 | 11.7 | 2.52 | 1.35 | 0.493 | 2.5 |
| Comp. Ex. 3 | 1480 | 950 | 86 | 93 | 14.7 | 22.3 | 11.9 | 11.6 | 1.51 | 0.97 | 0.383 | 3.0 |
| Comp. Ex. 4 | 1875 | 162 | 83 | 80 | 18.8 | 29.6 | 17.9 | 14.1 | 1.57 | 0.79 | 0.393 | 3.0 |
| Comp. Ex. 5 | 1811 | 977 | 87 | 87 | 15.6 | 29.4 | 12.2 | 12.0 | 1.89 | 0.98 | 0.542 | 2.5 |

INDUSTRIAL APPLICABILITY

By using the elastic circular-knitted fabric of the present invention, a satisfactory garment such as, for example, an undergarment, sportswear, or article of casual clothing in which stretchability and texture are combined can be provided.

REFERENCE SIGNS LIST

A knitted loops (c1) composed of non-elastic fibers

B non-elastic fibers forming the same loops as elastic fibers constituting knitted loops (c2) composed of non-elastic fibers and elastic fibers.

C elastic fibers constituting knitted loops (c2) composed of non-elastic fibers and elastic fibers.

The invention claimed is:

1. An elastic circular-knitted fabric comprising knitted loops (c1) composed of non-elastic fibers, and knitted loops (c2) composed of non-elastic fibers and elastic fibers, wherein the knitted loops (c2) composed of non-elastic fibers and elastic fibers are present in a ratio of one course for every two courses, elongation stress curves of the elastic circular-knitted fabric in the warp and weft directions have a ratio (a2/a1) of a slope (a1) at 0 to 40% elongation and a slope (a2) at 40 to 80% elongation of not greater than 1.0 in the respective directions, and the standard deviation of unevenness between loops on a rear surface of the elastic circular-knitted fabric is not greater than 0.5.

2. The elastic circular-knitted fabric according to claim 1, wherein a yarn length index ratio (c1/c2) of the knitted loops (c1) composed of non-elastic fibers to the knitted loops (c2) composed of non-elastic fibers and elastic fibers is 1.3 to 1.7.

3. The elastic circular-knitted fabric according to claim 1, wherein the slope (a2) in the warp direction at 40 to 80% elongation is not greater than 20 cN/%.

4. The elastic circular-knitted fabric according to claim 1, wherein a fineness ratio of the fineness of the non-elastic fibers used in the knitted loops (c1) composed of non-elastic fibers to the fineness of the non-elastic fibers used in the knitted loops (c2) composed of non-elastic fibers and elastic fibers is 2.0 to 4.0.

5. The elastic circular-knitted fabric according to claim 1, having a basis weight of 80 to 300 g/m$^2$.

6. The elastic circular-knitted fabric according to claim 1, having a plain stitch structure.

7. The elastic circular-knitted fabric according to claim 2, wherein the slope (a2) in the warp direction at 40 to 80% elongation is not greater than 20 cN/%.

8. The elastic circular-knitted fabric according to claim 2, wherein a fineness ratio of the fineness of the non-elastic fibers used in the knitted loops (c1) composed of non-elastic fibers to the fineness of the non-elastic fibers used in the knitted loops (c2) composed of non-elastic fibers and elastic fibers is 2.0 to 4.0.

9. The elastic circular-knitted fabric according to claim 3, wherein a fineness ratio of the fineness of the non-elastic fibers used in the knitted loops (c1) composed of non-elastic fibers to the fineness of the non-elastic fibers used in the knitted loops (c2) composed of non-elastic fibers and elastic fibers is 2.0 to 4.0.

10. The elastic circular-knitted fabric according to claim 2, having a basis weight of 80 to 300 g/m$^2$.

11. The elastic circular-knitted fabric according to claim 3, having a basis weight of 80 to 300 g/m$^2$.

12. The elastic circular-knitted fabric according to claim 4, having a basis weight of 80 to 300 g/m$^2$.

13. The elastic circular-knitted fabric according to claim 2, having a plain stitch structure.

14. The elastic circular-knitted fabric according to claim 3, having a plain stitch structure.

15. The elastic circular-knitted fabric according to claim 4, having a plain stitch structure.

16. The elastic circular-knitted fabric according to claim 5, having a plain stitch structure.

* * * * *